US006151460A

United States Patent [19]

Sawaki

[11] Patent Number: 6,151,460

[45] **Date of Patent: *Nov. 21, 2000**

[54] IMAGE RECORDING DEVICE HAVING A DEVELOPING BIAS VOLTAGE OUTPUT CIRCUIT

[75] Inventor: Yukichi Sawaki, Nagoya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/316,130

[22] Filed: May 21, 1999

[30] Foreign Application Priority Data

May 21, 1998 [JP] Japan ..... P10-139423

[51] Int. Cl.[7] ..... G03G 15/06

[52] U.S. Cl. ..... 399/55; 399/15; 399/43

[58] Field of Search ..... 399/43, 53, 55, 399/49, 72, 81, 8, 9, 46, 15; 358/406, 504

[56] References Cited

U.S. PATENT DOCUMENTS

| | | | |
|---|---|---|---|
| 4,916,491 | 4/1990 | Katoh | 399/235 |
| 5,060,013 | 10/1991 | Spence | 399/72 |
| 5,214,471 | 5/1993 | Bares | 399/24 |
| 5,294,959 | 3/1994 | Nagao et al. | 399/46 X |
| 5,315,351 | 5/1994 | Matsushiro et al. | 399/49 |
| 5,483,328 | 1/1996 | Kawasaki et al. | 399/49 |

FOREIGN PATENT DOCUMENTS

| | | |
|---|---|---|
| 56-91259 | 7/1981 | Japan . |
| 57-85062-A | 5/1982 | Japan . |
| 57-85070-A | 5/1982 | Japan . |
| 58-150981 | 9/1983 | Japan . |
| 59-189362-A | 10/1984 | Japan . |
| 63-40178 | 2/1988 | Japan . |
| 63-153260-U-A | 10/1988 | Japan . |
| 63-239470-A | 10/1988 | Japan . |
| 64-46772-A | 2/1989 | Japan . |
| 1-107271-A | 4/1989 | Japan . |
| 1-147562-A | 6/1989 | Japan . |
| 1-198770-A | 8/1989 | Japan . |
| 1-177050-A | 9/1989 | Japan . |
| 1-263665-A | 10/1989 | Japan . |
| 2-32372-A | 2/1990 | Japan . |
| 2-91663-A | 3/1990 | Japan . |
| 2-129662-A | 5/1990 | Japan . |
| 2-168282-A | 6/1990 | Japan . |
| 2-87233-U | 7/1990 | Japan . |
| 3-15867-A | 1/1991 | Japan . |
| 4-346370 | 12/1992 | Japan . |
| 7-271116-A | 10/1995 | Japan . |
| 8-262817-A | 10/1996 | Japan . |
| 8-262849 | 10/1996 | Japan . |
| 10-48895-A | 2/1998 | Japan . |

*Primary Examiner*—Sophia S. Chen
*Attorney, Agent, or Firm*—Oliff & Berridge, PLC

[57] ABSTRACT

An image recording unit is provided with a developing bias voltage output circuit for outputting a developing bias voltage to a developing unit, to thereby cause the developing unit to develop, using toner, an electrostatic latent image, formed on an electrically-charged body, into a visible toner image. A CPU serves to output a developing bias voltage control signal to a developing bias voltage varying circuit. The CPU outputs a developing bias voltage control signal based on manual key operations performed by a user. In response to the developing bias voltage control signal, the developing bias voltage varying circuit controls the developing bias voltage output circuit to change the developing bias voltage to be outputted therefrom.

25 Claims, 8 Drawing Sheets

IMAGE RECORDING DEVICE HAVING A DEVELOPING BIAS VOLTAGE OUTPUT CIRCUIT

BACKGROUND OF THE INVENTION

1. Field of the Invention

The present invention relates to an electro-photographic image recording device.

2. Description of Related Art

When an electrophotographic image recording device, such as a laser printer, is used for a long period of time, sheets recorded by the image recording device will possibly suffer from undesirable small black spots which are dispersed on the white areas of the recording sheets. These small black spots are called toner fogging. When the black spots resulting from toner fogging are few in number or are extremely small in size, the black spots are not noticeable. However, when the black dots increase in size and in great numbers even locally on the recording sheet, then the print quality of the resultant recording sheet can greatly suffer.

In the image recording device, a high voltage board is provided. The high voltage board is mounted with a developing bias voltage output circuit for outputting a developing bias voltage to develop an electrostatic latent image, formed on an electrically-charged body, into a visible toner image. Conventionally, a variable resistor for varying the developing bias voltage is also mounted on the high voltage board. A user can suppress toner fogging by manually adjusting the variable resistor to change the amount of the developing bias voltage.

SUMMARY OF THE INVENTION

It is, however, difficult for the user to manually adjust the variable resistor for reasons described below. The high voltage board is mounted in the image recording device at such a position that the user can not easily access the high voltage board. This ensures that the user will not accidentally touch the high voltage board. The variable resistor has an adjustment knob adjustable by a screw driver. In order to adjust the variable resistor, the user holds a screw driver and then searches for the variable resistor in the image recording device with the screw driver. Once the user finds the variable resistor, the user attaches the screw driver to the knob of the variable resistor and rotate the screw driver in a predetermined direction. This operation is time consuming. In addition, the variable resistor of the type that can be adjusted using the screw driver is quite expensive, and therefore the overall cost for manufacturing the image recording device increase.

It is conceivable to provide a separate dial at an easily accessible position on the image recording device and to provide some type of linking mechanism to connect the dial to the adjustment knob of the variable resistor. With this configuration, the user can easily operate the dial to adjust the variable resistor. However, such configuration would considerably increase manufacturing cost of the image recording device.

In view of the above-described drawbacks, it is an objective of the present invention to provide an improved image recording device that can easily suppress toner fogging.

In order to attain the above and other objects, the present invention provides an image recording device, comprising: a recording unit developing an electrostatic latent image, formed on an electrically-charged body, into a toner visible image; a developing bias voltage output circuit outputting a developing bias voltage to the recording unit; a toner fogging detection unit detecting a degree of a toner fogging resulted by the recording unit; a developing bias voltage control signal output unit automatically outputting a developing bias voltage control signal when the detected toner fogging degree reaches a predetermined degree; and a developing bias voltage varying unit varying the developing bias voltage, to be outputted from the developing bias voltage output circuit, based on the developing bias voltage control signal.

Thus, the developing bias voltage can be automatically and immediately adjusted, based on the detected toner fogging degree, thereby restraining occurrence of toner fogging. For example, the developing bias voltage control signal output unit may be realized by a CPU that controls the entire portion of the image recording device. The developing bias voltage varying unit may be realized by an inexpensive photo-transistor that turns ON and OFF control of the developing bias voltage. It is unnecessary to use any inexpensive variable resistor, and therefore possible to reduce the production cost of the device.

The recording unit may transfer the toner visible image onto a recording sheet, wherein the toner fogging detection unit includes a density sensor detecting a density of the recording sheet, onto which the toner visible image has been transferred, the density sensor detecting the density on the recording sheet at a predetermined region where the toner visible image has not been transferred, and wherein the developing bias voltage control signal output unit automatically outputs the developing bias voltage control signal when the detected density reaches a predetermined value.

The toner fogging detection unit may include a recording number count unit counting the number the recording unit has performed the recording operation, and wherein the developing bias voltage control signal output unit outputs the developing bias voltage control signal when the number counted by the recording number count unit reaches a predetermined value. By previously examining the relationship between the number the recording operation is performed and the toner fogging degree, the device of the present invention can automatically adjust the developing bias voltage according to the number of times the recording operation is performed, thereby restraining occurrence of the toner fogging phenomenon. Because the recording number counter is provided in the image recording device for other objectives, the production cost of the device does not increase.

The image recording device may further comprise an input device enabling a user to input his/her desire to change the developing bias voltage, wherein the developing bias voltage control signal output unit outputs the developing bias voltage control signal in response to an input of the user's desire to change the developing bias voltage.

The input device may be provided with a key to be manipulated by the user to indicate his/her desire to change the developing bias voltage. According to the image recording device, it is possible to allow the user to easily control the image recording device to restrain occurrence of fogging phenomenon without increasing the production cost of the device.

The developing bias voltage varying unit may vary, based on the developing bias voltage control signal, the developing bias voltage in a range defined between a predetermined minimum value and a predetermined maximum value. Because the developing bias voltage can be changed within the predetermined range, it is ensured that the device will not operate in error due to an abnormally-adjusted developing bias voltage. The developing bias voltage varying unit may vary the developing bias voltage by a predetermined unit value in response to each developing bias voltage control signal.

According to another aspect, the present invention provides an image recording device, comprising: a recording unit developing an electrostatic latent image, formed on an electrically-charged body, into a toner visible image to thereby perform a recording operation; a developing bias voltage output circuit outputting a developing bias voltage to the recording unit; a recording number count unit counting the number the recording unit has performed the recording operation; a developing bias voltage control signal output unit outputting a developing bias voltage control signal when the number counted by the recording number count unit reaches a predetermined value; and a developing bias voltage varying unit varying the developing bias voltage, to be outputted from the developing bias voltage output circuit, based on the developing bias voltage control signal.

According to still another aspect, the present invention provides an image recording device, comprising: a recording unit developing an electrostatic latent image, formed on an electrically-charged body, into a toner visible image; a developing bias voltage output circuit outputting a developing bias voltage to the recording unit; an input device enabling a user to input his/her desire to change the developing bias voltage; a developing bias voltage control signal output unit outputting a developing bias voltage control signal in response to an input of the user's desire to change the developing bias voltage; and a developing bias voltage varying unit varying the developing bias voltage, to be outputted from the developing bias voltage output circuit, in a range defined between a predetermined minimum value and a predetermined maximum value, the developing bias voltage varying unit varying the developing bias voltage by a predetermined unit value in response to the developing bias voltage control signal.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
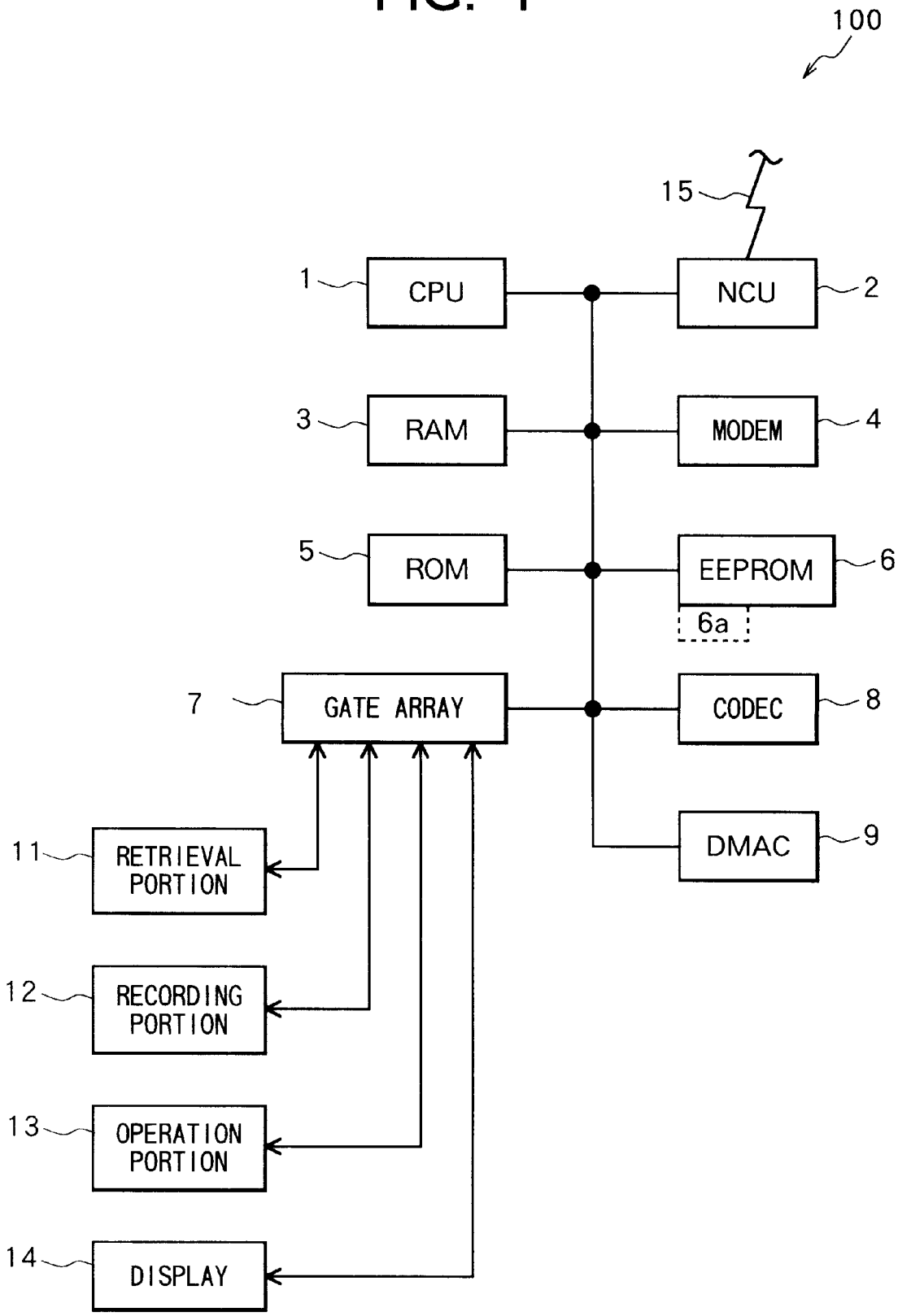
FIG. 1 is a block diagram showing electric components of a facsimile machine provided with an image recording device of a first embodiment of the present invention.

An image recording device according to preferred embodiments of the present invention will be described while referring to the accompanying drawings wherein like parts and components are designated by the same reference numerals to avoid duplicating description.

First Embodiment

An image recording device according to a first embodiment will be described below with reference to FIGS. 1–5.

FIG. 1 shows a facsimile machine 100 that employs the image recording device of the present embodiment.

As shown in FIG. 1, the facsimile machine 100 includes: a central processing unit (CPU) 1, a network control unit (NCU) 2, an random access memory (RAM) 3, a modem 4, a read only memory (ROM) 5, an electric erasable and programmable read only memory (EEPROM) 6, a gate array 7, a CODEC 8, a direct memory access controller (DMAC) 9, an image retrieving portion 11, an image recording portion 12, an operation portion 13, and a display 14. The CPU 1, the NCU 2, the RAM 3, the modem 4, the ROM 5, the EEPROM 6, the gate array 7, the CODEC 8, and the DMAC 9 are connected to one another by a bus line. The bus line includes an address bus, a data bus, and control signal lines. The image retrieving portion 11, the image recording portion 12, the operation portion 13, and the display 14 are connected to the gate array 7. A telephone circuit 15 is connected to the NCU 2.

The CPU 1 is for controlling the overall operations of the facsimile device 100. The CPU 1 executes programs stored in the ROM 5. As will be described later, the CPU 1 cooperates with the gate array 7 to output a developing bias voltage control signal "Vcontrol" and a developing bias voltage on/off signal ("Von" or "Voff") to the image recording unit 12. More specifically, the CPU 1 serves to retrieve developing bias voltage control data "Dcontrol" from the EEPROM 6 and supply the developing bias voltage control data "Dcontrol" to the gate array 7, thereby causing the gate array 7 to convert the developing bias voltage control data "Dcontrol" into an analog developing bias voltage control signal "Vcontrol" and to supply the developing bias voltage control signal "Vcontrol" to the image recording unit 12. The CPU 1 also serves to output developing bias voltage on/off data ("Don" or "Doff") to the gate array 7, thereby causing the gate array 7 to convert the developing bias voltage on/off data ("Don" or "Doff") into an analog developing bias voltage on/off signal ("Von" or "Voff") and to supply the developing bias voltage on/off signal ("Von" or "Voff") to the image recording unit 12. It is noted that the CPU 1 outputs the developing bias voltage ON data "Don" in order that a developing bias voltage "Vbias" (to be described later) can be controlled by the developing bias control signal "Vcontrol".

The NCU 2 is for performing network control. The RAM 3 stores a variety of different types of data. The modem 4 is for performing modulation of data to be transmitted to remote facsimile machines and demodulation of data received from remote facsimile machines. The ROM 5 stores therein a variety of different programs, such as a developing bias voltage changing process program shown in FIG. 5. The EEPROM 6 is for storing a variety of operation parameters, registration data, and flags. For example, the EEPROM 6 stores developing bias control data "Dcontrol" for determining the amount of the developing bias voltage "Vbias" to be described later. The gate array 7 function as an input/output interface of the CPU 1 and performs a variety of processes onto retrieved image signals. When receiving the developing bias voltage control data "Dcontrol", the gate array 7 converts the developing bias voltage control data "Dcontrol" into an analog developing bias voltage control voltage "Vcontrol" and supplies the developing bias voltage control signal "Vcontrol" to the image recording unit 12. When receiving the developing bias voltage on/off data ("Don" or "Doff"), the gate array 7 converts the developing bias voltage on/off data ("Don" or "Doff") into a corresponding analog developing bias voltage on/off voltage ("Von" or "Voff") and supplies the developing bias voltage on/off signal ("Von" or "Voff") to the image recording unit 12.

The CODEC 8 is for encoding data for facsimile transmissions and for decoding data transmitted from a remote facsimile machine. The DMAC 9 is for writing data into and retrieving data from the RAM 3.

The operation portion 13 includes a plurality of key switches. The operation portion 13 outputs signals according to operations of the key switches by a user. The display 14 includes a liquid crystal display (LCD). The display 14 is controlled by the CPU 1 to display a variety of messages and images.

The image retrieving portion 11 is provided with a light source, a line image sensor, and a document feed motor, although not shown in the drawings. The image retrieving portion 11 reads an original document and outputs analog image signals accordingly.

The image recording portion 12 is for recording images, either received from remote facsimile machines or retrieved using the image retrieval portion 11, onto a recording sheet. The image recording portion 12 includes an electrophotographic printing mechanism, shown in FIG. 2, that first forms an electrostatic latent image with using a laser beam, that then develops the latent image with toner to form a monochrome or color image, and then that transfers the image onto the recording sheet.

The electro-photographic mechanism provided in the image recording portion 12 will be described below in greater detail with reference to FIG. 2.

Figure 2:
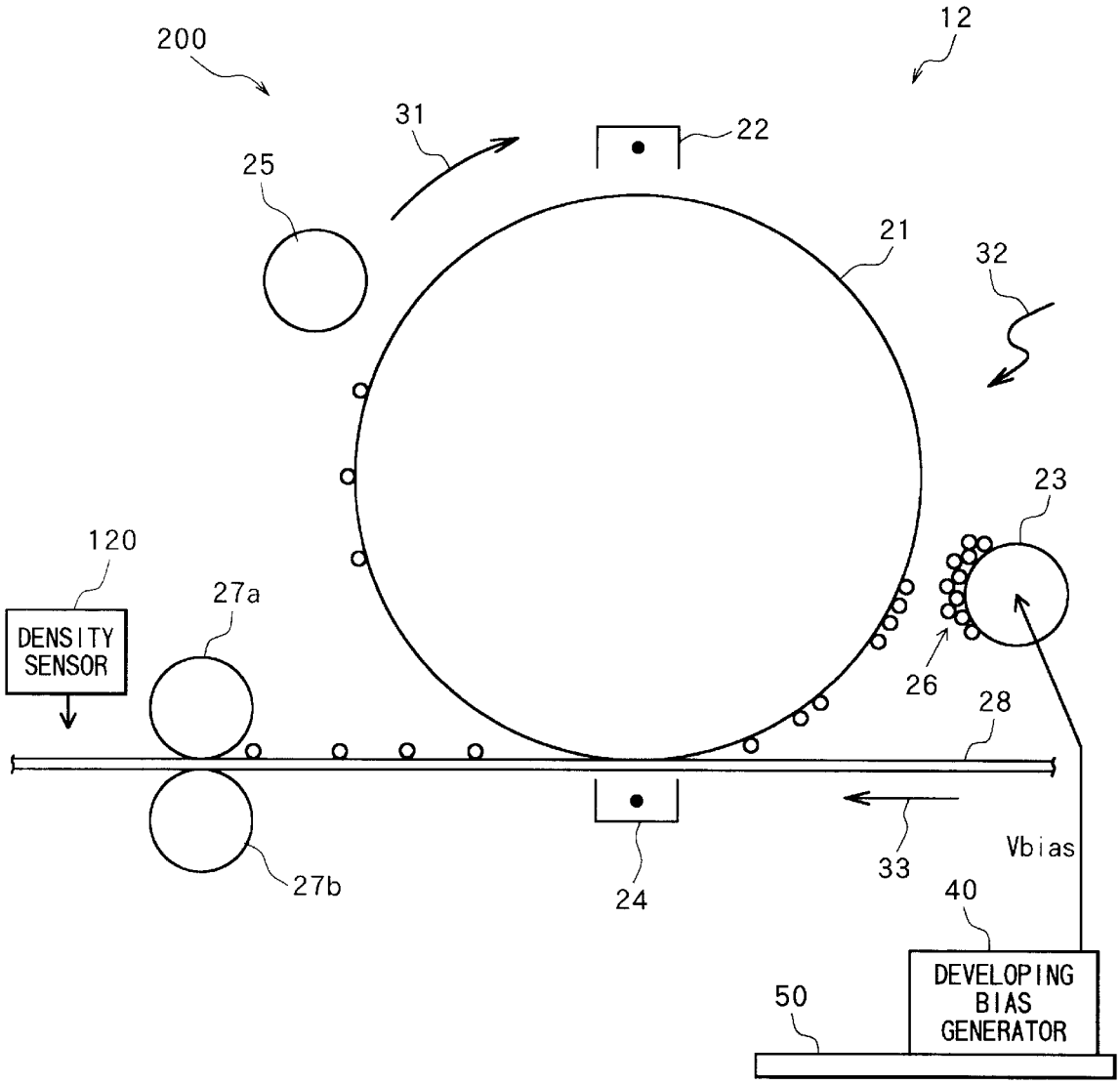
FIG. 2 is a schematic view showing electro-photographic mechanism provided in an image recording portion as the image recording device.

As shown in FIG. 2, the electro-photographic mechanism includes a photosensitive drum 21. Around the periphery of the photosensitive drum 21, a charge unit 22, a developing unit 23, a transfer unit 24, and a cleaning unit 25 are provided.

The photosensitive drum 21 is driven to rotate in a direction, indicated by an arrow 31, in order to be electrically charged and then to bear toner thereon.

The charge unit 22 is for electrically charging the surface of the photosensitive drum 21 to a uniform electric charge.

The outer surface of the photosensitive drum 21 is selectively irradiated by a laser light 32, at a position between the charge unit 22 and the developing unit 23, in order to form an electrostatic latent image on the outer surface of the photosensitive drum 21. The developing unit 23 is applied with a developing bias voltage "Vbias" to present a proper electric potential relative to the electrically-charged photosensitive drum 21 so that electrically-charged toner 26 can be properly supplied from the developing unit 23 to the outer surface of the photosensitive drum 21. As a result, the electrostatic latent image is developed into a visible toner image.

The transfer unit 24 is for transferring the toner 26 clinging to the surface of the photosensitive drum 21 onto a recording sheet 28 that is transported by a pair of transport rollers 27*a* and 27*b* in a direction indicated by an arrow 33. The cleaning unit 25 is for removing residual toner 26 remaining on the photosensitive drum 21.

The image recording portion 12 is further provided with a developing bias generating circuit 40 that is mounted on a high voltage board 50. The developing bias generating circuit 40 is for outputting the developing bias voltage "Vbias" and for applying the developing bias voltage "Vbias" to the developing unit 23.

Figure 3A:
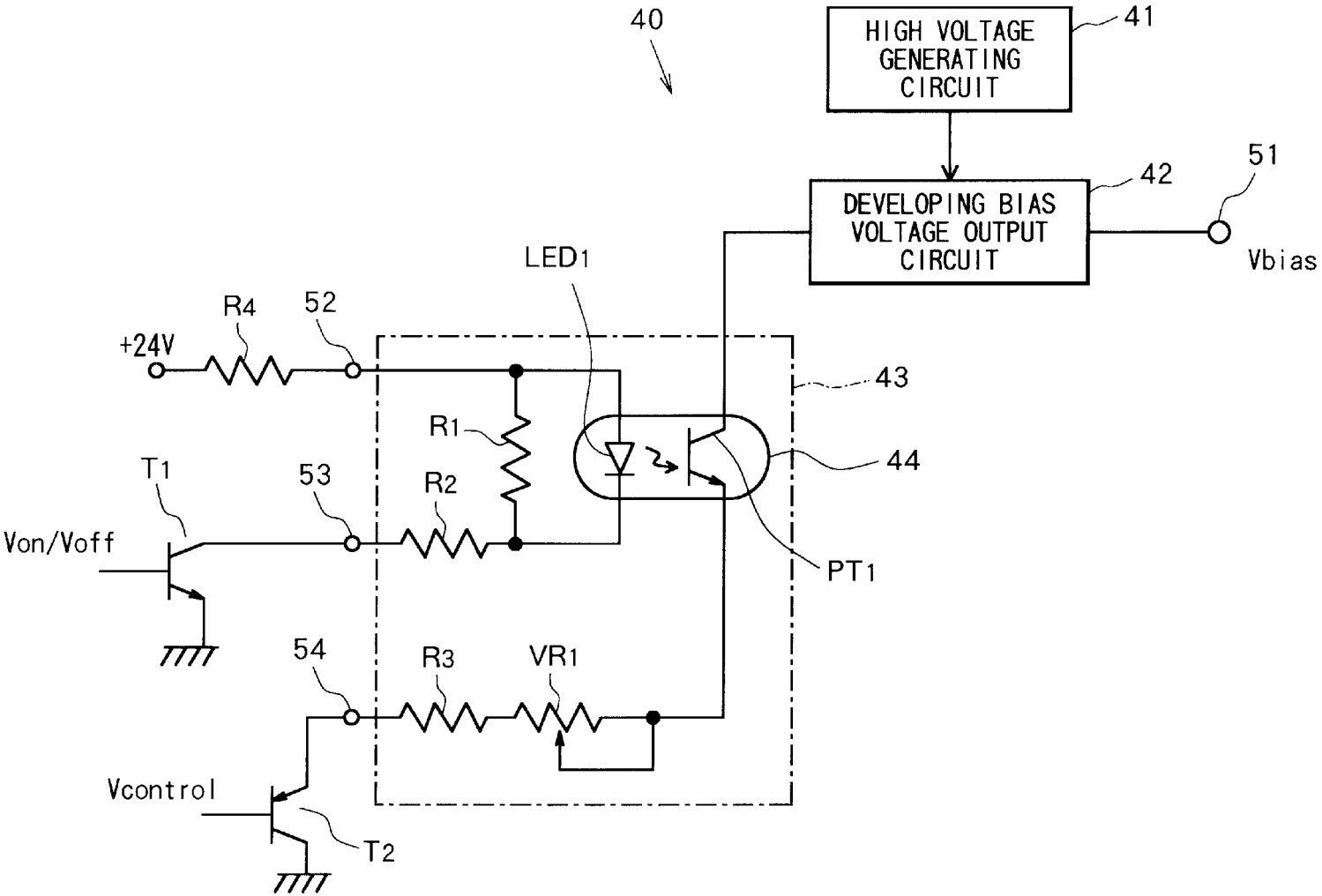
FIG. 3A is a circuit diagram showing a developing bias generating circuit provided to the image recording portion 12.

As shown in FIG. 3A, the developing bias generating circuit 40 includes: a high voltage generating circuit 41, a developing bias voltage output circuit 42, and a developing bias voltage varying circuit 43.

The high voltage generating circuit 41 is for boosting, rectifying, and smoothing an AC voltage, obtained from a commercial power source, into a DC voltage having a predetermined electric potential.

The developing bias voltage output circuit 42 is for using the DC voltage, supplied from the high voltage generating circuit 41, to generate the developing bias voltage "Vbias", and to output the developing bias voltage "Vbias" to the developing unit 23 through a terminal 51.

The developing bias voltage varying circuit 43 is for receiving the developing bias control voltage "Vcontrol" and the developing bias voltage on/off signal ("Von" or "Voff"), both of which are supplied via the gate array 7 from the CPU 1. When the developing bias voltage varying circuit 43 receives the developing bias voltage off signal "Voff", the developing bias voltage varying circuit 43 is incapable of controlling the developing bias voltage "Vbias" based on the developing bias control voltage "Vcontrol". On the other hand, when the developing bias voltage varying circuit 43 receives the developing bias voltage on signal "Von", the developing bias voltage varying circuit 43 becomes capable of controlling the amount of the developing bias voltage "Vbias" depending on the amount of the developing bias control voltage "Vcontrol". Thus, the developing bias voltage on/off signal ("Von" or "Voff") serves as a voltage control switching signal.

As shown in FIG. 3A, the developing bias voltage varying circuit 43 includes: a photocoupler 44, three resistors $R_1$ to $R_3$, and a variable resistor $VR_1$. The photocoupler 44 is comprised from a light emitting diode $LED_1$ and a phototransistor $PT_1$. The light emitting diode $LED_1$ is provided such that its anode is connected to one end of the resistor $R_1$ and to a terminal 52. The cathode of the light emitting diode $LED_1$ is connected to the other end of the resistor $R_1$, and one end of the resistor $R_2$. The other end of the resistor $R_2$ is connected to another terminal 53. The phototransistor $PT_1$ is provided such that its emitter is connected to still another terminal 54 via the variable resistor $VR_1$ and the resistor $R_3$. The collector of the phototransistor $PT_1$ is connected to the developing bias voltage output circuit 42.

It is noted that the variable resistor $VR_1$ provided in the developing bias voltage varying circuit 43 is not a type that is used in the conventional image recording devices, wherein the user can change the resistance value of the variable resistor as desired using the screw driver. The variable resistor $VR_1$ of the present embodiment is an inexpensive type that the user can not change the resistance value. The variable resistor $VR_1$ of this inexpensive type can only have its resistance value adjusted before being assembled onto the high voltage board 50 in the factory.

The terminal 52 is applied with a DC voltage of, for example, +24 volts via another resistor $R_4$. The terminal 53 is connected to the collector of a transistor T1. The emitter of the transistor T1 is grounded, and the base of the transistor T1 is electrically connected to the gate array 7 for receiving the developing bias voltage on/off signal ("Von" or "Voff") from the gate array 7. The developing bias voltage on/off signal ("Von" or "Voff") controls the transistor T1 to switch the terminal 53 to be grounded or to be opened. That is, when a developing bias voltage ON signal "Von" is inputted to the base of the transistor T1, the transistor T1 switches the terminal 53 to be grounded. As a result, the light emitting diode $LED_1$ illuminates, and the phototransistor $PT_1$ is rendered into an active state. The developing bias voltage output circuit 42 is therefore allowed to output the developing bias voltage "Vbias" whose amount is controlled by the developing bias voltage varying circuit 43.

On the other hand, when the developing bias voltage Off signal "Voff" is inputted to the base of the transistor T1, the transistor T1 switches the terminal 53 to be opened, whereupon the light emitting diode $LED_1$ is extinguished and the phototransistor $PT_1$ is rendered inactive. In this case, the terminal 51 will output the developing bias voltage "Vbias" of a fixed voltage.

The terminal 54 is connected to an emitter of another transistor T2. The collector of the transistor T2 is grounded, and the base of the transistor T2 is connected to the gate array 7 for receiving the developing bias control voltage "Vcontrol" from the gate array 7. The collector potential of the phototransistor $PT_1$ is therefore determined dependently on the developing bias control voltage "Vcontrol" supplied to the transistor T2.

Figure 3B:
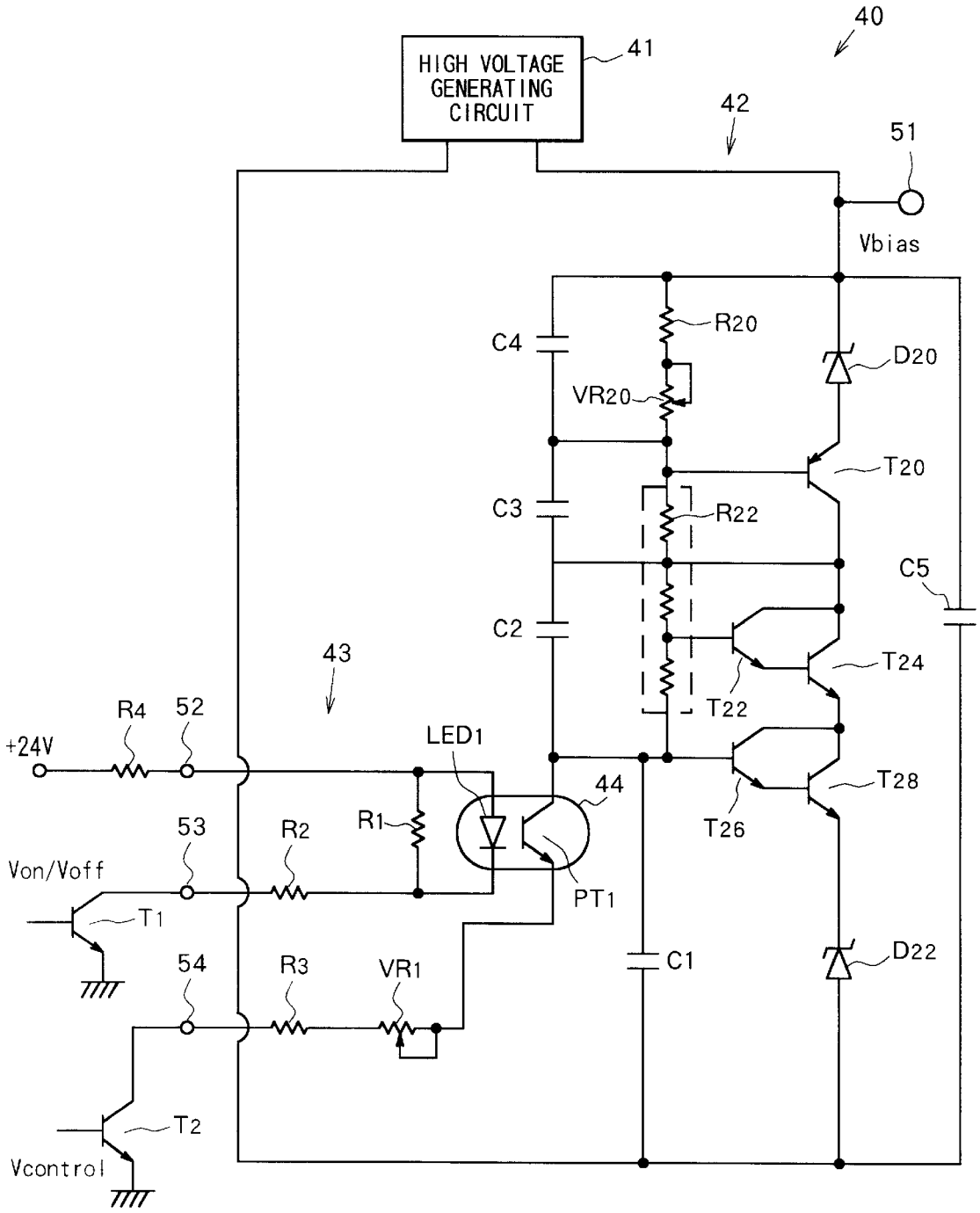
FIG. 3B is a circuit diagram showing a detailed structure of a developing bias voltage output circuit 42 in FIG. 3A.

The circuit structure of the developing bias voltage output circuit 42 is shown in greater detail in FIG. 3B. As shown in FIG. 3B, the developing bias voltage output circuit 42 includes: five capacitors C1–C5; a resistor R20; a variable resistor VR20; a series of resistors R22; five transistors T20, T22, T24, T26, and T28; and two zener diodes D20 and D22. The capacitors C1 and C2, one end of the resistor series R22, and the base of the transistor T26 are connected to the collector of the phototransistor $PT_1$ in the developing bias voltage varying circuit 43. The terminal 51 is connected to the zener diode D20, the resistor R20, and the capacitors C4 and C5. The transistors T20–T28 serve to determine the value of the developing bias voltage "Vbias", to be developed at the terminal 51, dependently on the collector potential of the phototransistor $PT_1$ in the developing bias voltage varying circuit 43.

Figure 4:
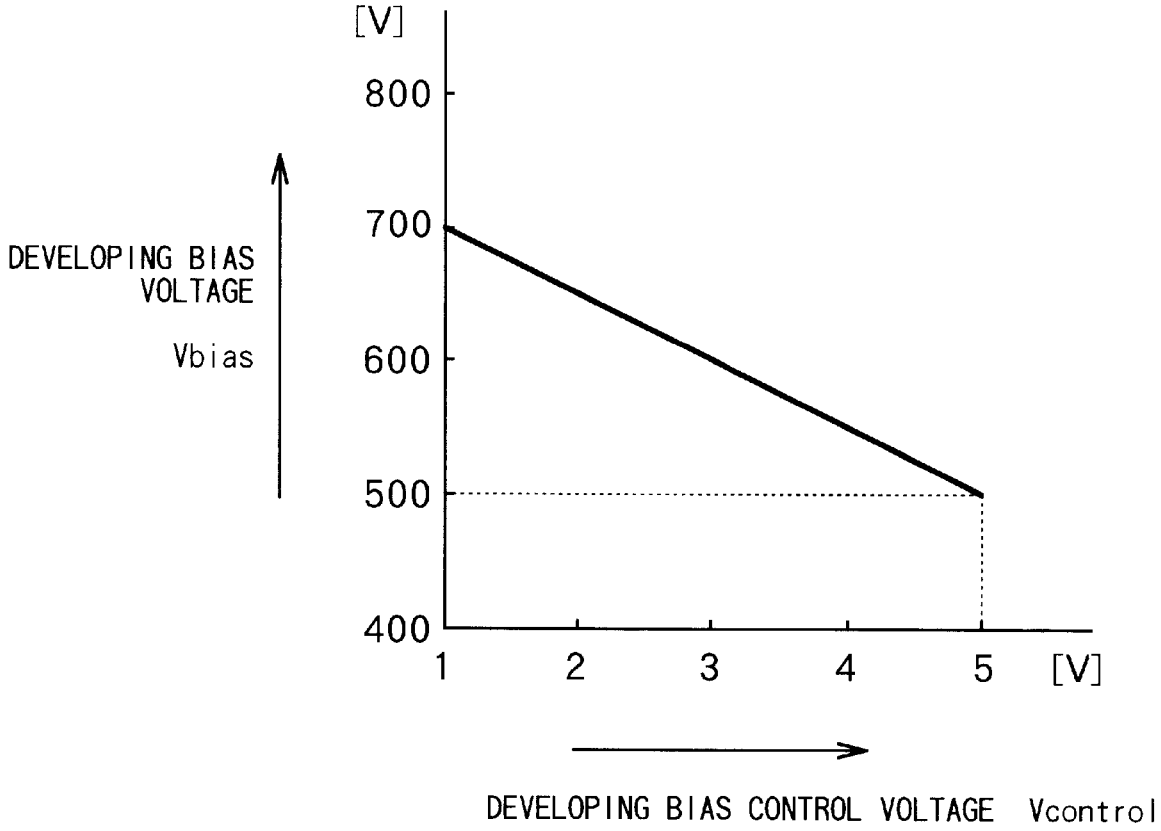
FIG. 4 is a graph showing the relationship between a developing bias control voltage inputted to the developing bias generating circuit and a developing bias voltage outputted from the developing bias generating circuit.

With this structure, when the developing bias voltage off signal "Voff" is applied to the transistor T1, the terminal 51 outputs a fixed voltage of about 280 volts, for example. On the other hand, when the developing bias voltage on signal "Von" is applied to the transistor T1, the terminal 51 outputs the developing bias voltage "Vbias" whose amount is determined dependently on the collector potential of the phototransistor $PT_1$. In this case, the amount of the developing bias voltage "Vbias" can be changed in accordance with changes in the amount of the developing bias control voltage "Vcontrol" supplied to the base of the transistor T2. In this example, the developing bias voltage varying circuit 43 and the developing bias voltage outputting circuit 42 cooperate to change the developing bias voltage "Vbias" from 700 volts to 500 volts in accordance with changes in the developing bias control voltage "Vcontrol" from 1 volt to 5 volts as shown in FIG. 4. As apparent from the graph of FIG. 4, as the developing bias control voltage "Vcontrol" increases in the range of 1 to 5 volts, the developing bias voltage "Vbias" decreases in the range of 700 volts to 500 volts. As the developing bias control voltage "Vcontrol" decreases in the range of 1 to 5 volts, the developing bias voltage "Vbias" increases in the range of 700 volts to 500 volts.

To supply the developing bias control voltage "Vcontrol" to the developing bias voltage varying circuit 43, the CPU 1 retrieves developing bias control data "Dcontrol" from the EEPROM 6 and outputs the developing bias control data "Dcontrol" to the gate array 7, which in turn converts the data "Dcontrol" into the analog developing bias control signal "Vcontrol". The gage array 7 performs its conversion operation so that the value of the developing bias control data "Dcontrol" and the value of the developing bias control voltage "Vcontrol" are in one to one correspondence with each other so that the developing bias control voltage "Vcontrol" will change inversely proportional to the value of the developing bias control data "Dcontrol". That is, when the value of the developing bias control data "Dcontrol" increases by a predetermined unit amount, the value of the developing bias control voltage "Vcontrol" will decrease by a corresponding predetermined unit amount. When the value of the developing bias control data "Dcontrol" decreases by the predetermined unit amount, the value of the developing bias control voltage "Vcontrol" will increase by the corresponding predetermined unit amount.

The developing bias control data "Dcontrol" stored in the EEPROM 6 can be rewritten by the CPU 1 to be changed according to predetermined key operations performed by the user on the operation portion 13. The gate array 7 is designed to induce a change by 0.5 volts in the developing bias control voltage "Vcontrol" when the value of the received developing bias control data "Dcontrol" changes by a single step. In response to the change in the developing bias control voltage "Vcontrol" by the 0.5 volt unit, the developing bias voltage varying circuit 43 and the developing bias voltage outputting circuit 42 cooperate to change the developing bias voltage "Vbias" by the 25 volt unit amount. Accordingly, when the developing bias control data "Dcontrol" increases by the predetermined unit value, the developing bias control voltage "Vcontrol" decreases by the 0.5 volt unit, and the developing bias voltage "Vbias" increases by the 25 volt unit amount. When the developing bias control data "Dcontrol" decreases by the predetermined unit value, the developing bias control voltage "Vcontrol" increases by the 0.5 volt unit, and the developing bias voltage "Vbias" decreases by the 25 volt unit amount. Thus, by changing the developing bias control data "Dcontrol" by the predetermined unit value steps, the developing bias control voltage "Vcontrol" changes by 0.5 volts steps in the range of 1 volt to 5 volts, and the developing bias voltage "Vbias" changes by 25 volts steps in the range of 700 volts to 500 volts.

It is noted that according to the present embodiment, the developing bias voltage "Vbias" is initially set at a predetermined standard voltage of 600 volts at factory. More specifically, the developing bias control data "Dcontrol", in the EEPROM 6, is initially set to a predetermined standard value so that the gate array 7 can output the developing bias control voltage "Vcontrol" of a predetermined standard value of 3 volts and so that the bias generating circuit 40 can generate the developing bias voltage "Vbias" of 600 volts at the terminal 51. The developing bias generating circuit 40 can change the developing bias voltage "Vbias" within the range of 500 volts to 700 volts.

Next, essential operations of the facsimile machine 100 with the above-described configuration will be explained.

It is noted that when it is desired to control the image recording portion 12 to perform recording operation, the high voltage generating circuit 41 is turned ON. Then, in order that the developing bias voltage "Vbias" can be controlled dependent on the developing bias control voltage "Vcontrol", the CPU 1 outputs the developing bias voltage ON data to the gate array 7. The gate array 7 supplies the developing bias voltage ON signal "Von" to the transistor T1. Accordingly, the phototransistor $PT_1$ is rendered active, whereby the developing bias generating circuit 40 is brought into a state that the developing bias voltage "Vbias" can be properly controlled in accordance with the developing bias control voltage "Vcontrol". The CPU 1 also outputs the developing bias control data "Dcontrol", that is presently stored in the EEPROM 6, to the gate array 7, which in turn supplies the developing bias control voltage "Vcontrol" of the corresponding amount to the transistor T2. Accordingly, the developing bias generating circuit 40 supplies the developing unit 23 with the developing bias voltage "Vbias" whose amount is properly controlled by the amount of the developing bias control voltage "Vcontrol".

It is noted that as described already, the developing bias control data "Dcontrol" and therefore the developing bias control signal "Vcontrol" are initially set to values so that the developing bias voltage "Vbias" of the standard voltage of 600 volts can be outputted at the terminal 51.

When the user wishes to adjust the amount of the developing bias voltage because toner fogging is generated on the recording sheet produced by the image recording portion 12, the user operates the predetermined key(s) on the operation portion 13 to set the facsimile machine 100 onto a mode for changing the developing bias voltage. As a result, information relating to the developing bias voltage "Vbias" is displayed on the screen of the display 14. The user then operates another predetermined key, on the operation portion 13, to indicate his or her desire to raise or lower the developing bias voltage. When the user performs the key operation in this manner, the developing bias control data "Dcontrol", presently stored in the EEPROM 6, is rewritten to be changed. The CPU 1 then retrieves the thus newly-set developing bias control data "Dcontrol" from the EEPROM 6 and supplies the developing bias control data "Dcontrol" to the gate array 7. The gate array 7 converts the developing bias control data "Dcontrol" into the analog developing bias control voltage "Vcontrol". The thus obtained developing bias control voltage "Vcontrol" is supplied to the transistor T2. Because the developing bias control voltage "Vcontrol" thus changes, the electric potential at the collector of the phototransistor $PT_1$ also changes. As a result, the developing bias voltage "Vbias", to be outputted from the developing bias voltage output circuit 42 to the developing unit 23, also changes.

Thus, the developing bias voltage "Vbias" can be changed within the predetermined range of 700 volts to 500 volts by the user's operation of the keys on the operation portion 13. The user can therefore easily control the facsimile machine 100 to suppress toner fogging. More specifically, the developing bias voltage output circuit 42 outputs the developing bias voltage "Vbias" to the developing unit 23 to develop an electrostatic latent image, on the electrically-charged body 21, into a visible toner image. The CPU 1 and the gate array 7 cooperate to output the developing bias voltage control signal "Vcontrol" based on the user's key operations and based on the developing bias voltage changing program (FIG. 5) stored in the ROM 5. The developing bias voltage varying circuit 43 changes the developing bias voltage "Vbias", to be outputted from the developing bias voltage output circuit 42, based on the developing bias voltage control signal "Vcontrol" supplied from the CPU 1 via the gate array 7.

In order to change the developing bias voltage "Vbias", the CPU 1 performs the developing bias voltage changing process as described below.

Figure 5:
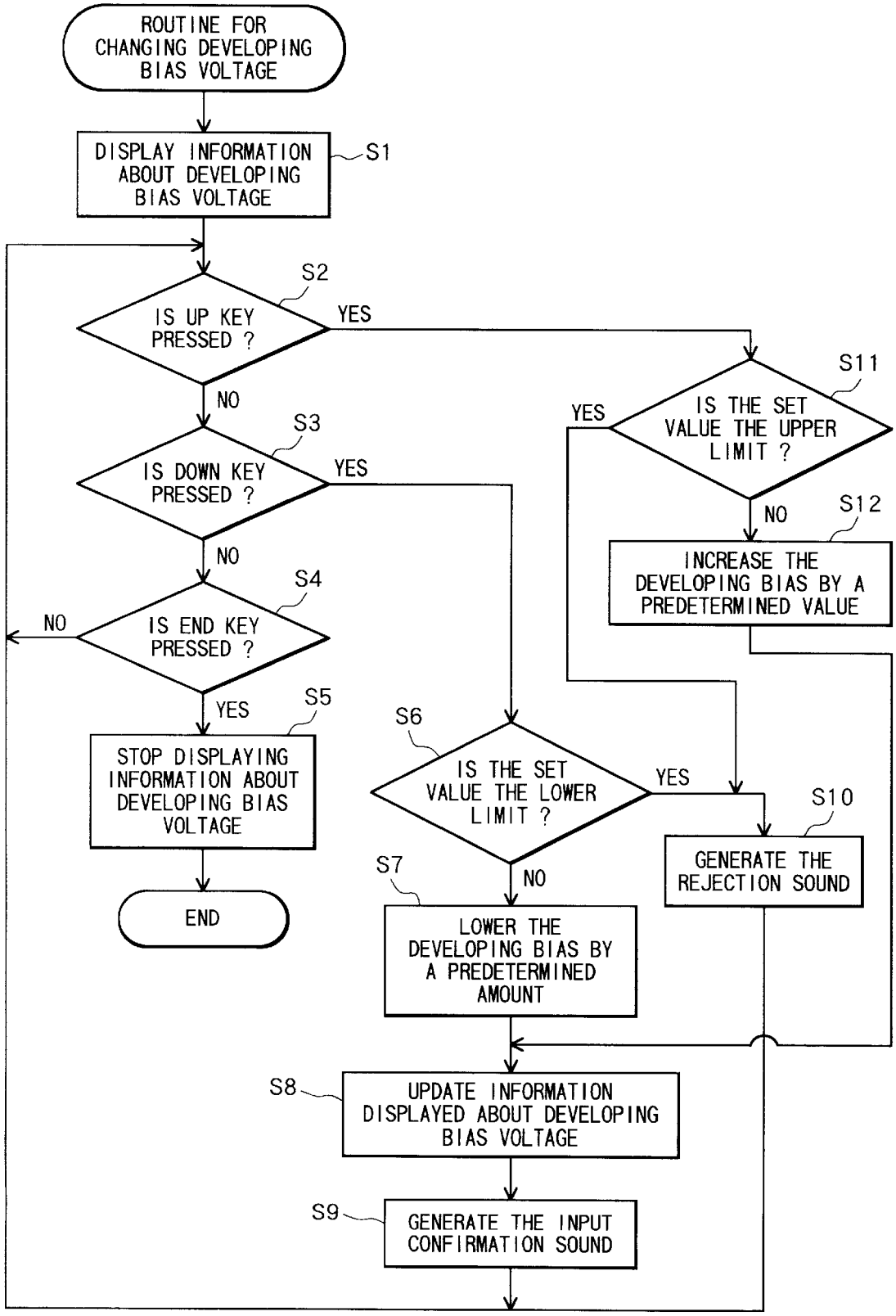
FIG. 5 is a flowchart representing a developing bias voltage changing process executed by a CPU provided in the facsimile machine of FIG. 1.

When the user manipulates the predetermined key(s) on the operation portion 13 to place the facsimile machine 100 into its mode for changing the developing bias voltage, the developing bias voltage changing process of FIG. 5 is started.

During the developing bias voltage changing process, first in S1, the CPU 1 controls the display 14 to display, on its screen, information about the developing bias voltage "Vbias" that is presently being generated by the developing bias generating circuit 40 to be applied to the developing unit 23. More specifically, during the process of S1, the CPU 1 first retrieves developing bias control data "Dcontrol" that is being presently stored in the EEPROM 6. The CPU 1 then calculates, based on the developing bias control data "Dcontrol", the amount of the present developing bias voltage "Vbias". The CPU 1 then controls the display 14 to show the calculated result. The display 14 continues displaying the information until the CPU 1 outputs a command to change or delete the presently-displayed information from the display 14.

It is noted that the value of the developing bias control data "Dcontrol" or the value of the developing bias control voltage "Vcontrol" can be displayed on the display 14 instead of the developing bias voltage "Vbias" itself. Alternatively, a relative value of the present developing bias voltage "Vbias", with respect to the predetermined standard developing bias voltage of 600 volts, could be displayed.

Next in S2, the CPU 1 judges whether or not the user has pressed an up key for increasing the amount of the developing bias voltage "Vbias". It is noted that one of the keys on the operation portion 13 is allotted to serve as the up key during the developing bias voltage changing mode. Accordingly, during the process of S2, the CPU 1 determines whether this key has been pressed down or not. If the up key has not been pressed down (S2:NO), in S3, the CPU 1 judges whether or not the user has pressed a down key for decreasing the amount of the developing bias voltage. It is noted that another one of the keys on the operation portion 13 is allotted to serve as the down key during the developing bias voltage changing mode. The CPU 1 therefore makes the judgement in S3 by investigating whether this key has been pressed down or not.

When the down key has not been pressed down (S3:NO), then in S4, the CPU 1 judges whether or not the user has pressed down an end key for finishing the developing bias voltage changing mode. It is noted that still another one of the keys on the operation portion 13 is allotted to serve as the end key during the developing bias voltage changing mode. The CPU 1 therefore performs the judgement in S4 by investigating whether this key is pressed down or not.

If the end key has been pressed down (S4:YES), then in S5, the CPU 1 stops display of the information about the developing bias voltage "Vbias" on the screen of the display 14. This ends the routine for changing the developing bias voltage "Vbias".

In S4, if the user has not pressed down the end key for ending the developing bias voltage changing mode (S4:NO), then the routine returns to S2 and waits for key input by the user.

In S3, if the user presses down the down key for decreasing the amount of the developing bias voltage "Vbias" (S3:YES), then in S6, the CPU 1 judges whether or not the presently-set value "Dcontrol" is a predetermined lower limit. More specifically, during the process of S6, the CPU 1 investigates whether or not the value of the developing bias control data "Dcontrol", presently stored in the EEPROM 6, is equal to or less than the predetermined lower limit. It is noted that as described already, the developing bias control data "Dcontrol" and the developing bias control voltage "Vcontrol" have inverse proportional relationship with respect to each other. The developing bias control voltage "Vcontrol" and the developing bias voltage "Vbias" have also inverse proportional relationship with respect to each other as shown in FIG. 4. Accordingly, the developing bias control data "Dcontrol" and the developing bias voltage "Vbias" have a directly proportional relationship. Thus, the lower limit value of the developing bias control data "Dcontrol" corresponds to the maximum value, 5 volts, of the developing bias control voltage "Vcontrol", and corresponds to the minimum value, 500 volts, of the variation range of the developing bias voltage "Vbias".

If the presently-set value "Dcontrol" is not the lower limit (S6:NO), then in S7, the CPU 1 lowers the developing bias voltage "Vbias" by 25 volts. More specifically, during the process of S7, the CPU 1 rewrites the present value of the developing bias control data "Dcontrol", that is stored in the EEPROM 6, with a new value that is smaller than the present value by a single unit value. Thus, the CPU 1 reduces the value of the developing bias control data "Dcontrol" by a single step. As a result, the developing bias control voltage "Vcontrol", that is produced by the gate array 7 and is supplied to the transistor T2, increases by 0.5 volts. As a result, the developing bias voltage "Vbias", that is generated at the terminal 51, decreases by 25 volts.

Next, in S8, the CPU 1 controls the display 14 to display the updated developing bias voltage "Vbias" on the screen of the display 14. In S9, the CPU 1 generates input confirmation sound by driving a speaker (not shown in the drawings) provided in the facsimile machine 100. Afterwards, the routine returns to S2. The input confirmation sound, generated in S9, notifies the user that the user's pressing down operation of the down key has been properly received.

On the other hand, in S6, if the presently-set value "Dcontrol" is the lower limit (S6:YES), then in S10, the CPU 1 generates a rejection sound by driving the speaker (not shown). Then, the routine returns to S2. The rejection sound informs the user that the input from the down key is not accepted.

On the other hand, in S2, if the user presses down the up key for increasing the developing bias voltage "Vbias" (S2:YES), then in S11, the CPU 1 judges whether or not the presently-set value "Dcontrol" is a predetermined upper limit. More specifically, during the process of S11, the CPU 1 investigates whether or not the developing bias control data "Dcontrol", presently stored in the EEPROM 6, is equal to or greater than the predetermined upper limit. It is noted that the upper limit value of the developing bias control data "Dcontrol" corresponds to the minimum value, 1 volt, of the developing bias control voltage "Vcontrol", and corresponds to the maximum value, 700 volts, of the changeable range of the developing bias voltage "Vbias".

If the presently-set value "Dcontrol" is not the upper limit (S11:NO), then in S12, the CPU 1 increases the developing bias voltage "Vbias" by 25 volts, and the routine proceeds to S8. More specifically, during the process of S12, the CPU 1 rewrites the developing bias control data "Dcontrol", presently stored in the EEPROM 6, with a new value that is greater than the present value by a single unit value. Thus, the CPU 1 increases the value of the developing bias control data "Dcontrol" by a single step. As a result, the developing bias control voltage "Vcontrol", supplies to the transistor T2, decreases by 0.5 volts. As a result, the developing bias voltage "Vbias" generated at the terminal 51 increases by 25 volts. On the other hand, in S11, if the presently-set value "Dcontrol" is the upper limit (S11:YES), then the routine proceeds to S10.

It is noted that in the above description, separate keys are provided as the up key and the down key. However, only one of the up key and the down key can be provided. If only the up key were provided, once operations of the up key increase the developing bias control data "Dcontrol" to the upper limit value, then further operation of the up key would return the developing bias control data "Dcontrol" to the lower limit value. Alternatively, when only the down key is provided, once operation of the down key reduces the developing bias control data "Dcontrol" to the lower limit value, then further operation of the down key would return the developing bias control data "Dcontrol" to the upper limit value.

Alternatively, if only the up key were provided, if the up key is not pressed down within a predetermined time period, then the developing bias control data "Dcontrol" can automatically be decreased by a single step. Alternatively, if only the down key is provided, when the down key is not pressed down during a predetermined time period, then the developing bias control data "Dcontrol" can be automatically increased by a single step.

In the above description, the amount that the developing bias control voltage "Vcontrol" changes by each step is equal to 0.5 volts. The amount that the developing bias voltage "Vbias" changes by each step is equal to 25 volts. However, the amounts that the developing bias control voltage "Vcontrol" and the developing bias voltage "Vbias" change by each step can be selected as other values.

In the above description, the developing bias control voltage "Vcontrol" can be changed in the range of 1 volt to 5 volts. The developing bias voltage "Vbias" can be changed in the range of 500 volts to 700 volts. However, the changeable range of the developing bias control voltage "Vcontrol" and the changeable range of the developing bias voltage "Vbias" can be set to other value ranges.

Further, the order of the processes of S7 to S9 in the flowchart of FIG. 5 can be altered as desired.

As described above, according to the present embodiment, the image recording unit 12 is provided with the developing bias generating circuit 40. The developing bias generating circuit 40 outputs the developing bias voltage "Vbias" to the developing unit 23, thereby allowing the developing unit 23 to develop the electrostatic latent image, formed on the electrically-charged body 21, into a visible toner image. The CPU 1 and the gate array 7 cooperate to output a developing bias voltage control signal "Vcontrol" based on manual key operations performed by a user. In response to the developing bias voltage control signal "Vcontrol", the developing bias voltage varying circuit 43 controls the developing bias voltage output circuit 42 to change the amount of the developing bias voltage "Vbias" to be outputted to the developing unit 23.

<Second Embodiment>

Next, a second embodiment of the present invention will be described below with reference to FIGS. 1–4 and 6.

In the embodiment described above, the developing bias voltage "Vbias" is changed in response to key operations performed by the user. However, the developing bias voltage "Vbias" can be automatically changed by a predetermined unit value every time a predetermined number of recording sheets are printed out.

According to the present embodiment, a recorded sheet number counter **6*a* is provided to the EEPROM 6 as indicated by a dotted line in FIG. 1. The recorded sheet number counter 6***a* is for counting the number of recording sheets printed by the image recording unit 12 and for storing data of the counted accumulative number of the printed recording sheet. It is noted that the photosensitive drum 21, the charge unit 22, the transfer unit 24, and the cleaning unit 25 (shown in FIG. 2) are assembled into a developing unit 200, and can be detachably mounted to the facsimile machine 100.

According to the present embodiment, the CPU 1 performs the developing bias voltage changing process based on the counted result of the recorded sheet number counter 6*a*. More specifically, the CPU 1 executes the routine of FIG. 6 for changing the developing bias voltage "Vbias" at the following timing: when the power switch of the facsimile machine 100 is turned on; when the image recording unit 12 completes printing a single recording sheet, or when the image recording unit 12 completes printing a series of plural sheets in succession.

It is noted that also in the present embodiment, the developing bias control data "Dcontrol" is initially set to the predetermined standard value so that the developing bias voltage "Vbias" of the standard voltage, 600 volts, can be generated at the terminal 51.

Figure 6:
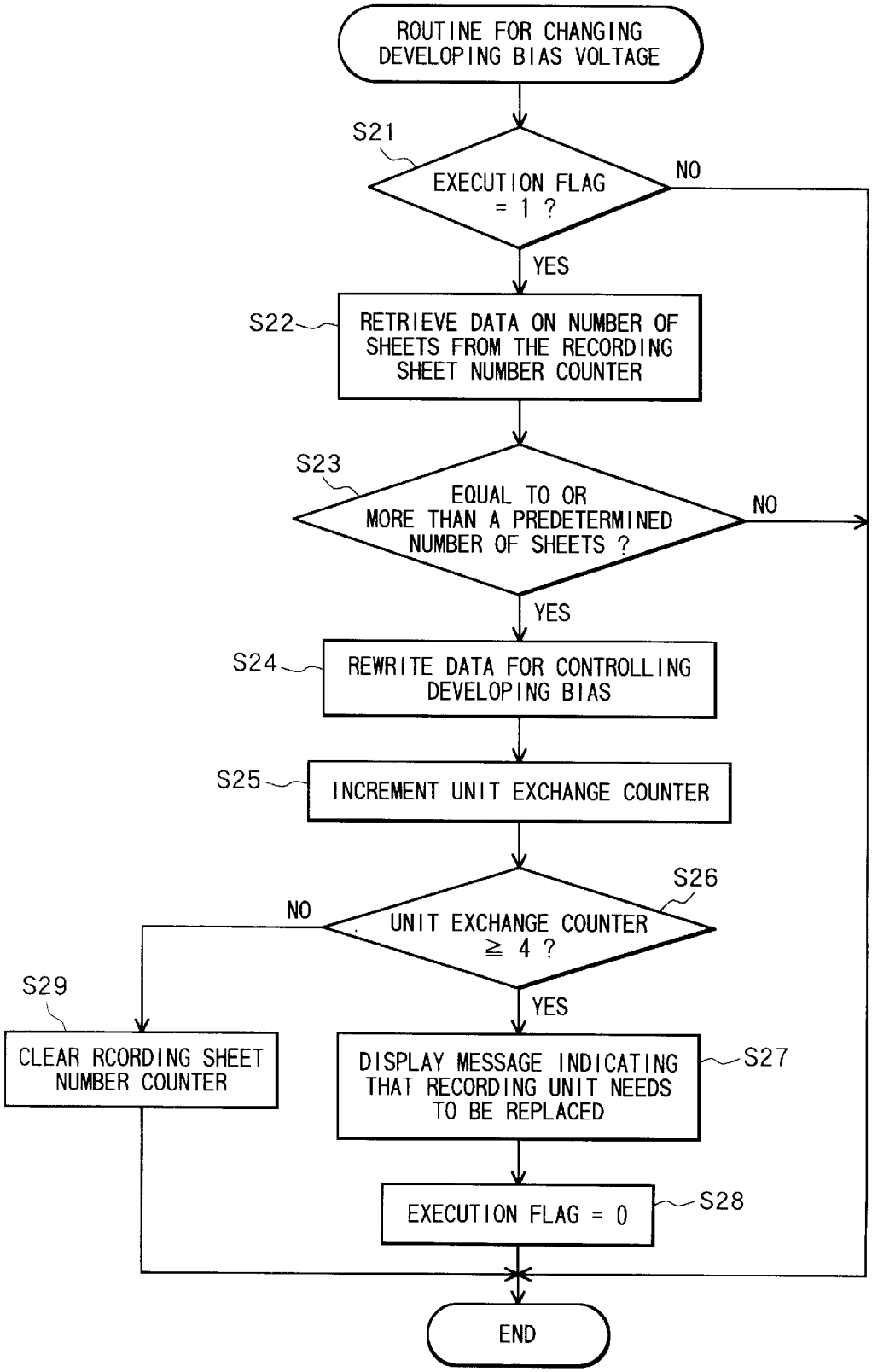
FIG. 6 is a flowchart representing a developing bias voltage changing process according to a second embodiment.

When the developing bias voltage changing process of FIG. 6 is started, first, the CPU 1 judges in S21 whether or not an execution flag, that is stored in the EEPROM 6, is being ON, that is, being set to one (1). It is noted that the execution flag is for representing whether or not the developing bias voltage "Vbias" has reached the upper limit value. That is, the execution flag of one (1) indicates that the developing bias voltage "Vbias" has not reached the upper limit value. The execution flag of zero (0) indicates that the developing bias voltage "Vbias" has reached the upper limit value.

If the execution flag is being set to one (1) (S21:YES), this means that the developing bias voltage "Vbias" has not reached the upper limit value of 700 volts. Accordingly, in S22, the CPU 1 retrieves, from the printed sheet number counter 6*a,* data of the accumulative number of the printed recording sheets. In S23, the CPU 1 judges whether or not the accumulative number of the printed recording sheets has reached or exceeded a predetermined number of, for example, 2,000 sheets.

If the accumulative number of printed recording sheets has reached or exceeded the predetermined number (S23:YES), this means that so many sheets have been printed that the developing bias voltage needs to be changed. Therefore, in S24, the CPU 1 rewrites the developing bias control data stored in the EEPROM 6 in order to increase the developing bias voltage by the single unit of 25 volts, for example. Next, in S25, the CPU 1 increments a unit exchange counter by one. It is noted that the unit exchange counter is set in the EEPROM 6 for indicating whether or not enough recording sheets have been printed to require exchanging of the developing unit 200 with a new one.

Then, in S26, the CPU 1 judges whether or not the unit exchange counter has reached a value of four (4) or more. If the unit exchange counter is four (4) or greater (S26:YES), this means that the developing bias voltage "Vbias" has reached the upper limit value of 700 volts, that the total number of printed recording sheets has reached or exceeded 8,000 sheets, and therefore that exchange of the developing unit 200 with a new one becomes necessary.

Accordingly, if the unit exchange counter is four (4) or greater (S26:YES), in S27, the CPU 1 displays a message on the screen of the display 14 informing the user of the need to exchange the developing unit 200 with a new one. This message is maintained on the display 14 until the user presses a predetermined key, the user opens the lid of the facsimile machine 100 to replace the developing unit 200 with a new one, or the user turns OFF the power source of the facsimile machine 100. Next, in S28, the CPU 1 rewrites the value of the execution flag, store din the EEPROM 6, to off, that is, to zero (0), in order to prevent the developing bias voltage "Vbias" from being increased any further. This ends the routine for changing developing bias voltage.

It is noted that when the user exchanges the recording unit 200 with a new one, the CPU 1 clears the recorded sheet number counter 6*a* and the unit exchange counter, rewrites the execution flag, stored in the EEPROM 6, to one (1), and rewrites the developing bias control data "Dcontrol", stored in the EEPROM 6, to the predetermined standard control value so that the developing bias generating circuit 40 will output the standard developing bias voltage "Vbias" of 600 volts to the developing unit 23.

On the other hand, in S26, if the counter value of the unit exchange counter is not four (4) or greater (S26:NO), this means that the developing bias voltage has not yet reached the upper limit value of 700 volts and that the total number of recorded sheets is less than 8,000 sheets, so there is no need to replace the recording unit 200 with a new one. Therefore, in S29, the CPU 1 clears the recorded number counter 6*a* in order to restart counting the accumulative number of recorded sheets until the next time the developing bias voltage "Vbias" needs to be changed. This ends the present routine for changing the developing bias voltage.

On the other hand, in S23, if the counter value in the recorded sheet number counter 6*a* is not equal to or greater than the predetermined number (S23:NO), this means that the fewer sheets have been recorded than the number that requires the developing bias voltage "Vbias" to be changed. Therefore, the routine for changing the developing bias voltage is ended.

In S21, if the execution flag is not one (1) (S21:NO), this means that the developing bias voltage has reached the upper limit value of 700 volts. Therefore, the routine for changing the developing bias voltage is ended without increasing the developing bias voltage.

It is noted that the message to inform in S27 the user that the recording unit 200 should be replaced with a new one can be performed verbally by a voice message. Or, the message can be displayed on the display 14 together with the voice message.

The amount that the developing bias voltage "Vbias" is changed in each step need no be fixed to 25 volts, but could instead differ for each different step. For example, it is preferable to previously experimentally determine optimum values for the developing bias voltages "Vbias" accompanying increase in the number of recorded sheets from the time that the recording unit 200 is exchanged with a new one. A plurality of sets of developing bias control data "Dcontrol" corresponding to those optimum values are then stored in a table format in the EEPROM 6. More specifically, it is preferable to previously experimentally determine: a first optimum value for the developing bias voltages "Vbias" desired to be generated when 2,000 sheets of paper have been recorded from the time that the recording unit 200 is exchanged with a new one; a second optimum value for the developing bias voltages "Vbias" desired to be generated when 4,000 sheets of paper have been recorded; and a third optimum value for the developing bias voltages "Vbias" desired to be generated when 6,000 sheets of paper have been recorded. Three sets of developing bias control data "Dcontrol" corresponding to those three optimum values "Vbias" are stored in a table format in the EEPROM 6. During the developing bias voltage changing process of FIG. 6, the developing bias control data "Dcontrol" is changed in S24 in accordance with the table of the EEPROM 6. As a result, the degree of change in the developing bias voltage "Vbias" will be different for each of the first through fourth timings the developing bias voltage "Vbias" is changed.

After the developing bias voltage "Vbias" is automatically changed through the process of FIG. 6, when the user manipulates the operation portion 13 to input his/her desire to further change the developing bias voltage "Vbias" more minutely, the process of FIG. 5 may be started being executed. In this case, the developing bias voltage changing process of FIG. 5 may be modified so that the user can input, in S2 or S3, not only his/her desire to increase or decrease the developing bias voltage "Vbias" but also the changing amount, by which the developing bias voltage "Vbias" is desired to be changed. In S7 or S12, the CPU 1 first calculates the value of the developing bias control data "Dcontrol", to which the present developing bias control data "Dcontrol" should be changed, dependently on the user's inputted changing amount. The CPU 1 then rewrites the present developing bias control data "Dcontrol" into the thus calculated value, thereby changing the developing bias voltage "Vbias" by the user's desired amount.

<Third Embodiment>

A third embodiment of the present invention will be described below with reference to FIGS. 1–4 and 7.

In the above-described second embodiment, the developing bias voltage "Vbias" is changed according to the number of recorded sheets. However, according to the present embodiment, the developing bias voltage "Vbias" is changed according to the degree of toner fogging. More specifically, according to the present embodiment, the degree of toner fogging is detected every time the image recording unit 12 has printed a predetermined number of sheets. For example, the degree of toner fogging is detected every time the image recording unit 12 has printed a single sheet. According to the detection results, the developing bias voltage "Vbias" is automatically changed.

According to the present embodiment, a density sensor 120 is provided in the image recording unit 12 as shown in FIG. 2. The density sensor 120 is located in a downstream side of the image transfer unit 24 along the sheet conveying direction 33. The density sensor 120 is for detecting an average density of a predetermined are on the printed sheet 28 within its predetermined non-recorded region. It is noted that the predetermined non-recorded region is defined as a region on the sheet 28 that is located outside a region where images are recordable by the photosensitive drum 21. For example, if the sheet 28 has a greater width than the photosensitive drum 21, the predetermined non-recorded region can be defined on a widthwise edge of the sheet 28 that is located outside the region that corresponds to the photosensitive drum 21. The density sensor 120 is designed to emit light onto the predetermined area on the printed sheet 28 and to detect light reflected from the printed sheet 28.

Figure 7:
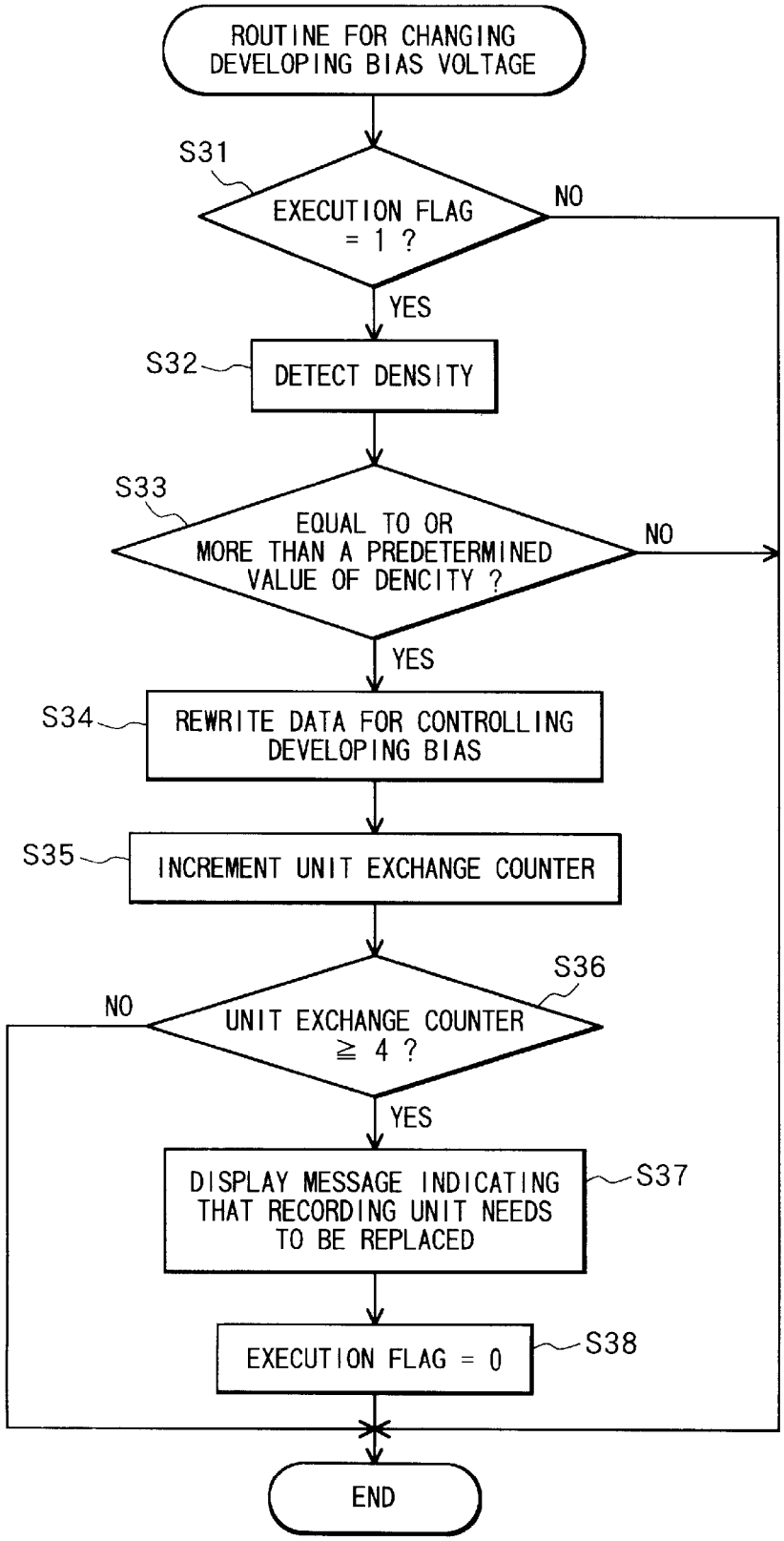
FIG. 7 is a flowchart representing a developing bias voltage changing process according to a third embodiment.

According to the present embodiment, the CPU 1 performs a developing bias voltage changing process of FIG. 7 every time the image recording unit 12 has printed a predetermined number of sheets. In this example, the CPU 1 performs the developing bias voltage changing process every time the image recording unit 12 has printed a single sheet. Steps S31–S38 of the process of FIG. 7 are the same as steps S21–S28 of the process of FIG. 6 (second embodiment) except that the CPU 1 controls in S32 the density sensor 120 to detect the average density of the predetermined area on the printed sheet 28 and except that the CPU 1 judges in S33 whether the detected average density is equal to or greater than a predetermined value. Additionally, in the process of FIG. 7, no step is required for clearing the recording sheet number counter. However, it should be appreciated that, in a case in which density detection is performed after, say two or more sheets, rather than after every sheet as in this example, additional steps of retrieving data of a number of sheets from a recording sheet number counter, determining whether the number of sheets is equal to or more than a predetermined number of sheets, and subsequently clearing the recording sheet number counter would be required.

If the detected average density reaches the predetermined value (yes in S23), then the CPU 1 automatically rewrites in S34 the developing bias control data, stored in the EEPROM 6, into a new value that is greater than the present value "Dcontrol" by a single step, thereby increasing the developing bias voltage by 25 volts.

After the developing bias voltage "Vbias" is thus automatically changed dependently on the detected toner fogging degree, when the user manipulates the operation portion 13 to input his/her desire to further change the developing bias voltage "Vbias" minutely, the process of FIG. 5 may be started being executed. In this case, the developing bias voltage changing process of FIG. 5 may be modified so that the user can input, in S2 or S3, not only his/her desire to increase or decrease the developing bias voltage "Vbias" but also the changing amount, by which the developing bias voltage "Vbias" is desired to be changed. In S7 or S12, the CPU 1 first calculates the value of the developing bias control data "Dcontrol", to which the present developing bias control data "Dcontrol" should be changed, dependently on the user's inputted changing amount. The CPU 1 then rewrites the present developing bias control data "Dcontrol" into the thus calculated value, thereby changing the developing bias voltage "Vbias" by the user's desired amount.

While the invention has been described in detail with reference to the specific embodiments thereof, it would be apparent to those skilled in the art that various changes and modifications may be made therein without departing from the spirit of the invention.

For example, in the above-described embodiments, the image recording device of the present invention is applied to the facsimile machine 100. However, the image recording device according to the present invention can be used in other various devices, such as a printer, a copy machine, and a multi-function device that performs a variety of function s such as a facsimile communication function, a printer function, and a copy function.

In the above-described embodiments, the electrically-charged body is constructed from the photosensitive drum 21. However, the electrically-charged body is not limited to the photosensitive drum. For example, a photosensitive belt may be used as the electrically-charged body.

In the embodiments, the electrostatic latent image is formed by a laser beam 32. However, the electrostatic latent image may be formed according to other methods. For example, the electrostatic latent image may be used by light emitted from a light emission diode, for example.

In the embodiments, the developing bias voltage control signal is a voltage representing a value, into which the developing bias voltage should be increased or decreased. However, the developing bias voltage control signal is not limited to the voltage. For example, the developing bias voltage control signal may be an electric current whose amount represents a value, into which the developing bias voltage should be increased or decreased.

What is claimed is:

1. An image recording device, comprising:

a recording unit developing an electrostatic latent image, formed on an electrically-charged body, into a toner visible image and transferring the toner visible image onto a recording sheet, thereby recording the toner visible image on the recording sheet;

a developing bias voltage output circuit outputting a developing bias voltage to the recording unit;

a toner fogging detection unit detecting a degree of toner fogging resulted by the recording unit, the toner fogging detection unit including a density sensor that detects a density of the recording sheet onto which the toner visible image has been recorded by the recording unit, the density sensor detecting the density on the recording sheet at a predetermined non-recorded region that is located outside of a region where toner visible images are recorded by the recording unit;

a developing bias voltage control signal output unit automatically outputting a developing bias voltage control signal when the detected toner fogging degree determined by the detected density reaches a predetermined degree; and a developing bias voltage varying unit varying the developing bias voltage, to be outputted from the developing bias voltage output circuit, based on the developing bias voltage control signal.

2. An image recording device as claimed in claim 1, further comprising an input device enabling a user to input his/her desire to further change the developing bias voltage, wherein the developing bias voltage control signal output unit outputs another developing bias voltage control signal in response to an input of the user's desire to further change the developing bias voltage.

3. An image recording device as claimed in claim 1, wherein the developing bias voltage varying unit varies, based on the developing bias voltage control signal, the developing bias voltage in a range defined between a predetermined minimum value and a predetermined maximum value.

4. An image recording device as claimed in claim 3, wherein the developing bias voltage varying unit varies the developing bias voltage by a predetermined unit value in response to each developing bias voltage control signal.

5. An image recording device as claimed in claim 1, wherein the recording sheet has a width greater than the electrically-charged body, the predetermined non-recorded region being defined on a widthwise edge of the recording sheet that is located outside a region of the recording sheet where images are recordable by the electrically-charged body.

6. An image recording device, comprising:

a recording unit developing an electrostatic latent image, formed on an electrically-charged body, into a toner visible image;

a developing bias voltage output circuit outputting a developing bias voltage to the recording unit;

an input device enabling a user to input his/her desire to change the developing bias voltage;

a developing bias voltage control signal output unit outputting a developing bias voltage control signal in response to an input of the user's desire to change the developing bias voltage; and a developing bias voltage varying unit varying the developing bias voltage, to be outputted from the developing bias voltage output circuit, in a range defined between a predetermined minimum value and a predetermined maximum value, the developing bias voltage varying unit varying the developing bias voltage by a predetermined unit value in response to the developing bias voltage control signal.

7. An image recording device, comprising:

a recording unit developing an electrostatic latent image, formed on an electrically-charged body, into a toner visible image;

a developing bias voltage output circuit outputting a developing bias voltage to the recording unit;

a toner fogging detection unit detecting a degree of toner fogging resulted by the recording unit;

a developing bias voltage control signal output unit automatically outputting a first developing bias voltage control signal when the detected toner fogging degree reaches a predetermined degree;

a developing bias voltage varying unit varying the developing bias voltage, to be outputted from the developing bias voltage output circuit, based on the developing bias voltage control signal; and an input device enabling a user to input his/her desire to further change the developing bias voltage, the developing bias voltage control signal output unit outputting a second developing bias voltage control signal in response to an input of the user's desire to further change the developing bias voltage.

8. An image recording device as claimed in claim 7, wherein the developing bias voltage varying unit varies, based on the developing bias voltage control signal, the developing bias voltage in a range defined between a predetermined minimum value and a predetermined maximum value.

9. An image recording device as claimed in claim 7, wherein the toner fogging detection unit includes a recording number count unit counting the number of times the recording unit has performed the recording operation, and wherein the developing bias voltage control signal output unit outputs the developing bias voltage control signal when the number counted by the recording number count unit reaches a predetermined value.

10. An image recording device, comprising:

a recording unit developing an electrostatic latent image, formed on an electrically-charge body, into a toner visible image;

a developing bias voltage output circuit outputting a developing bias voltage to the recording unit;

a toner fogging detection unit detecting a degree of toner fogging resulted by the recording unit;

a developing bias voltage control signal output unit automatically outputting a developing bias voltage control signal when the detected toner fogging degree reaches a predetermined degree; and a developing bias voltage varying unit varying the developing bias voltage, to be outputted from the developing bias voltage output circuit, based on the developing bias voltage control signal, the developing bias voltage varying unit varying the developing bias voltage by a predetermined unit value in response to each developing bias voltage control signal.

11. An image recording device as claimed in claim 10, wherein the developing bias voltage varying unit varies, based on the developing bias voltage control signal, the developing bias voltage in a range defined between a predetermined minimum value and a predetermined maximum value.

12. An image recording device as claimed in claim 10, wherein the toner fogging detection unit includes a recording number count unit counting the number of times the recording unit has performed the recording operation, and wherein the developing bias voltage control signal output unit outputs the developing bias voltage control signal when the number counted by the recording number count unit reaches a predetermined value.

13. An image recording device, comprising:

a recording unit developing an electrostatic latent image, formed to an electrically-charged body, into a toner visible image, to thereby perform a recording operation;

a developing bias voltage output circuit outputting a developing bias voltage to the recording unit;

a toner fogging detection unit detecting a degree of a toner fogging resulted by the recording unit;

a developing bias voltage control signal output unit automatically outputting a developing bias voltage control signal each time the detected result by the toner fogging detection unit indicates that the toner fogging degree reaches one of a plurality of predetermined degrees;

an informing unit that informs a user of a need to exchange the recording unit with a new recording unit when the detected result by the toner fogging detection unit indicates that the toner fogging degree reaches a predetermined threshold degree;

a developing bias voltage varying unit varying the developing bias voltage, to be outputted from the developing bias voltage output circuit, based on the developing bias voltage control signal, the developing bias voltage varying unit varying the developing bias voltage by one of a plurality of unit values, in response to each developing bias voltage control signal, thereby varying the developing bias voltage in a predetermined range, the plurality of unit values being equal to at least one of a plurality of different values, and allowing the developing bias voltage to have a valve equal to a predetermined limit voltage, which is defined within the predetermined range, when the detected result by the toner fogging detection unit indicates that the toner fogging degree reaches the predetermined threshold degree.

14. An image recording device as claimed in claim 13, wherein the recording unit develops the electrostatic latent image into the toner visible image and transfers the toner visible image onto a recording sheet, thereby recording the toner visible image on the recording sheet, wherein the toner fogging detection unit includes:

a density sensor that detects a density of the recording sheet onto which the toner visible image has been recorded by the recording unit; and a unit exchange counter that increments an exchange count number by one every time the density detected by the density sensor reaches a predetermined density value, wherein the developing bias voltage control signal output unit outputs a developing bias voltage control signal every time the density detected by the density sensor reaches the predetermined density value, wherein the informing unit informs the user of the need to exchange the recording unit with a new recording unit when the exchange count number reaches a predetermined threshold number, and wherein the developing bias voltage varying unit varies the developing bias voltage by a predetermined unit value every time the density detected by the density sensor reaches the predetermined density value, thereby varying the developing bias voltage in the predetermined range, the predetermined unit value allowing the developing bias voltage to have a value equal to the predetermined limit voltage when the exchange count number reaches the predetermined threshold number.

15. An image recording device as claimed in claim 14, further comprising:

a prohibiting unit that prohibits, when the exchange count number reaches the predetermined threshold number, the developing bias voltage from varying, the prohibiting unit performing the prohibiting operation until the recording unit is exchanged with a new recording unit; and an initializing unit that executes, when the recording unit is exchanged with the new recording unit, to control the developing bias output circuit to output the developing bias voltage of a predetermined minimum value that is defined within the predetermined range, while allowing the developing bias voltage to vary, wherein the developing bias voltage varying unit varies the developing bias voltage to cause the developing bias voltage to have a value equal to a sum of the predetermined minimum value and a product of the predetermined unit value and a present exchange count number, the sum of the predetermined minimum value and the product of the predetermined unit value and the present exchange count number having a predetermined maximum value within the predetermined range when the present exchange count number reaches the predetermined threshold number.

16. An image recording device as claimed in claim 13, further comprising an input device enabling a user to input his/her desire to further change the developing bias voltage, the developing bias voltage control signal output unit outputting an additional developing bias voltage control signal in response to an input of the user's desire to further change the developing bias voltage.

17. An image recording device as claimed in claim 13, wherein the toner fogging detection unit includes:

a recording number counter that counts a number of times that a recording unit has performed the recording operation and that is cleared every time the counted number reaches a predetermined recording number; and a unit exchange counter that increments an exchange count number by one every time the number counted by the recording number counter reaches the predetermined recording number, wherein the developing bias voltage control signal output unit outputs a developing bias voltage control signal every time the number counted by the recording number counter reaches the predetermined recording number, wherein the informing unit informs the user of the need to exchange the recording unit with a new recording unit when the exchange count number reaches a predetermined threshold number, and wherein the developing bias voltage varying unit varies the developing bias voltage by a predetermined unit every time the recording number counted by the recording number counter reaches the predetermined recording number, thereby varying the developing bias voltage in the predetermined range, the predetermined unit value allowing the developing bias voltage to have a value equal to the predetermined limit voltage when the exchange count number reaches the predetermined threshold number.

18. An image recording device as claimed in claim 13, wherein the developing bias voltage varying unit varies the developing bias voltage by a predetermined unit value, in response to each developing bias voltage control signal, thereby varying the developing bias voltage in the predetermined range, the predetermined unit value allowing the developing bias voltage to have a value equal to the predetermined limit voltage when the detected result by the toner fogging detection unit indicates that the toner fogging degree reaches the predetermined threshold degree.

19. An image recording device as claimed in claim 13, wherein the developing bias voltage varying unit varies the developing bias voltage by one of a plurality of predetermined unit values, in response to each developing bias voltage control signal, thereby varying the developing bias voltage in the predetermined range, the plurality of predetermined unit values being equal to a plurality of different values and allowing the developing bias voltage to have a value equal to the predetermined limit voltage when the detected result by the toner fogging detection unit indicates that the toner fogging degree reaches the predetermined threshold degree.

20. An image recording device, comprising:

a recording unit developing an electrostatic latent image, formed on an electrically-charged body, into a toner visible image, to thereby perform a recording operation;

a developing bias voltage output circuit outputting a developing bias voltage to the recording unit;

a recording number count unit counting a number of times the recording unit has performed the recording operation;

a developing bias voltage control signal output unit automatically outputting a developing bias voltage control signal every time the number counted by the recording number count unit indicates that a total number of times that the recording unit has performed the recording operation reaches one of a plurality of predetermined values;

an informing unit that informs a user of a need to exchange the recording unit with a new recording unit when the counted number indicates that the total number of times that the recording unit has performed the recording operation reaches a predetermined threshold value; and a developing bias voltage varying unit varying the developing bias voltage, to be outputted from the developing bias voltage output circuit, based on the developing bias voltage control signal, the developing bias voltage varying unit varying the developing bias voltage by one of a plurality of unit values, in response to each developing bias voltage control signal, thereby varying the developing bias voltage in a predetermined range, the plurality of unit values being equal to at least one of a plurality of different values, and allowing the developing bias voltage to have a equal to a predetermined limit voltage, which is defined within the predetermined range, when the counted number indicates that the total number of times that the recording unit has performed the recording operation reaches the predetermined threshold value.

21. An image recording device as claimed in claim 20, wherein the recording number count unit includes:

a recording number counter that counts the number of times that the recording unit has performed the recording operation and that is cleared every time the counted number reaches a predetermined recording number; and a unit exchange counter that increments an exchange count number by one every time the number counted by the recording number counter reaches the predetermined recording number, wherein the developing bias voltage control signal output unit outputs a developing bias voltage control signal every time the number counted by the recording number counter reaches the predetermined recording number, wherein the informing unit informs the user of the need to exchange the recording unit with a new recording unit when the exchange count number reaches a predetermined threshold number, and wherein the developing bias voltage varying unit varies the developing bias voltage by a predetermined unit value every time the recording number counted by the recording number counter reaches the predetermined recording number, thereby varying the developing bias voltage in the predetermined range, the predetermined unit value allowing the developing bias voltage to have a value equal to the predetermined limit voltage when the exchange count number reaches the predetermined threshold number.

22. An image recording device as claimed in claim 21, further comprising:

a prohibiting unit that prohibits, when the exchange count number reaches the predetermined threshold number, the developing bias voltage from varying, the prohibiting unit performing the prohibiting operation until the recording unit is exchanged with a new recording unit; and an initializing unit that executes, when the recording unit is exchanged with the new recording unit, to control the developing bias output circuit to output the developing bias voltage of a predetermined minimum value that is defined within the predetermined range, while allowing the developing bias voltage to vary, wherein the developing bias voltage varying unit varies the developing bias voltage to cause the developing bias voltage to have a value equal to a sum of the predetermined minimum value and a product of the predetermined unit value and a present exchange count number, the sum of the predetermined minimum value and the product of the predetermined unit value and the present exchange count number having a predetermined maximum value within the predetermined range when the present exchange count number reaches the predetermined threshold number.

23. An image recording device as claimed in claim 20, further comprising an input device enabling a user to input his/her desire to further change the developing bias voltage, the developing bias voltage control signal output unit outputting an additional developing bias voltage control signal in response to an input of the user's desire to further change the developing bias voltage.

24. An image recording device as claimed in claim 20, wherein the developing bias voltage varying unit varies the developing bias voltage by a predetermined unit value, in response to each developing bias voltage control signal, thereby varying the developing bias voltage in the predetermined range, the predetermined unit value allowing the developing bias voltage to have a value equal to the predetermined limit value when the counted number indicates that the total number that the recording unit has performed the recording operation reaches the predetermined threshold value.

25. An image recording device as claimed in claim 20, wherein the developing bias voltage varying unit varies the developing bias voltage by one of a plurality of predetermined unit values, in response to each developing bias voltage control signal, thereby varying the developing bias voltage in the predetermined range, the plurality of predetermined unit values being equal to a plurality of different values and allowing the developing bias voltage to have a value equal to the predetermined limit value when the counted number indicates that the total number of times that the recording unit has performed the recording operation reaches the predetermined threshold value.

* * * * *